United States Patent [19]

Choe

[11] Patent Number: 4,542,882

[45] Date of Patent: Sep. 24, 1985

[54] AIR JACK FOR USE WITH A VEHICLE EXHAUST SYSTEM

[76] Inventor: David Choe, 60 Bridge Town St., Staten Island, N.Y. 10314

[21] Appl. No.: 602,169

[22] Filed: Apr. 19, 1984

[51] Int. Cl.[4] ..... B66F 3/24

[52] U.S. Cl. ..... 254/93 HP

[58] Field of Search ..... 254/93 HP, 93 H, DIG. 1; 285/402

[56] References Cited

U.S. PATENT DOCUMENTS

| | | | |
|---|---|---|---|
| 2,495,092 | 1/1950 | Cox et al. | 254/93 HP |
| 4,061,310 | 12/1977 | Vetter | 254/93 HP |
| 4,203,577 | 5/1980 | Hafner | 254/DIG. 1 |
| 4,218,043 | 8/1980 | LeVert | 254/DIG. 1 |
| 4,222,549 | 9/1980 | Lindgren | 254/93 HP |
| 4,294,141 | 10/1981 | Miller | 254/93 HP |
| 4,477,109 | 10/1984 | Kleuver | 285/402 |

FOREIGN PATENT DOCUMENTS

| | | | |
|---|---|---|---|
| 2354388 | 1/1973 | Fed. Rep. of Germany | 254/93 HP |

*Primary Examiner*—Robert C. Watson

*Attorney, Agent, or Firm*—Birch, Stewart, Kolasch & Birch

[57] ABSTRACT

An air jack for use in raising vehicles from the ground comprising an air bag, a hose member which is adapted to connect the exhaust system of a vehicle to the air bag and a valve for preventing the release of exhaust gases from the air bag after it has been inflated.

6 Claims, 5 Drawing Figures

AIR JACK FOR USE WITH A VEHICLE EXHAUST SYSTEM

BACKGROUND AND FIELD OF THE INVENTION

The present invention relates to an air jack for use with a vehicle exhaust system and more particularly to an air jack comprising an inflatable member (air bag) which is capable of being inflated and expanded through the introduction of exhaust gas into its interior. The air jack of the present invention can be used to raise any desired part of the vehicle for purposes of repairing a tire, repairing part of the under carriage of the vehicle, performing general maintenance work on the vehicle and the like.

Presently known vehicle jacks are made of steel and are hand operated through the use of gear systems, pneumatic systems and the like. These types of jacks are very difficult to operate, particularly for a woman, a young adult or a weak man. Furthermore, because of the weight of some metallic vehicle jacks, it is inconvenient and difficult to operate such jacks for lifting an auto body to change a flat tire. The problems are compounded in bad weather, such as rain or snow, or on irregular surfaces, when trying to stabilize the jack so that the vehicle does not fall off the jack when in a raised position.

SUMMARY AND OBJECTS OF THE INVENTION

It is therefore an object of the present invention to provide an air jack which makes effective use of the exhaust gas of a vehicle for inflating a flexible member (air bag) which in turn can be used to raise the vehicle.

It is another object of the present invention to provide an air jack which, when inflated, has a ballon-like configuration and which is supported on one side thereof with a plurality of studs which functions to eliminate slipping when the air jack is inflated and under load.

It is a further object of the present invention to provide an air jack which is provided with a hose which contains a cone shaped adapter at one end thereof to facilitate connection with exhaust systems for vehicles having exhaust pipes of various diameters. A back valve is disposed in the hose to prevent a back flow from the expanded air bag when the vehicle is in a raised position. The gas can be released from the expanded air bag by disconnecting the hose at the entrance to the air bag.

Still another object of the present invention is to provide an air jack which is easy to operate, is light in weight and accordingly can be readily carried by a woman or a young adult.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
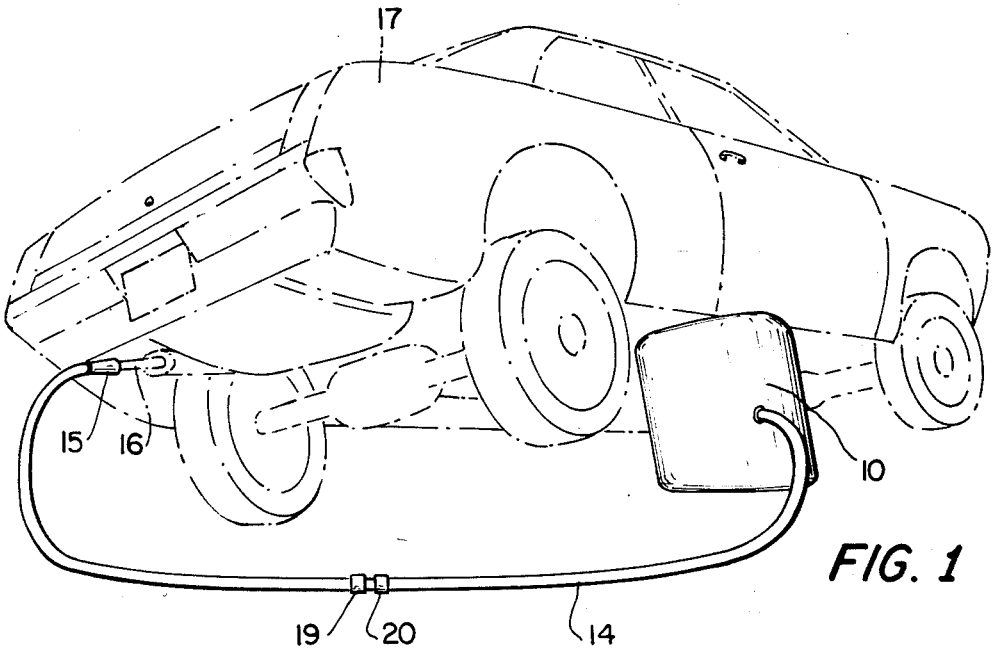
FIG. 1 is a perspective view of an automobile which is being raised by the air jack of the present invention using the exhaust gas from the exhaust system of the vehicle.
Figure 2:
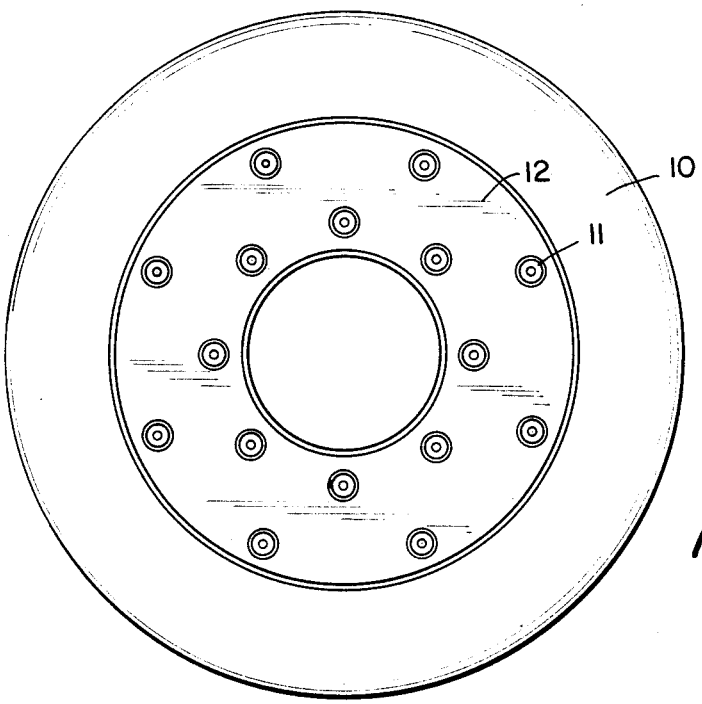
FIG. 2 is a bottom view of a friction plate which is attached to the inflatable air bag to avoid slippage of the air jack during its operation.
Figure 3:
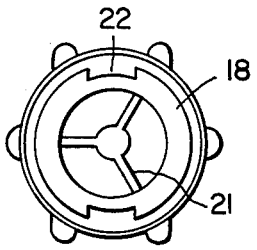
FIG. 3 is an end view of the hose connector which is attached to the end of the hose for securing the hose to the inflatable air bag.
Figure 4:
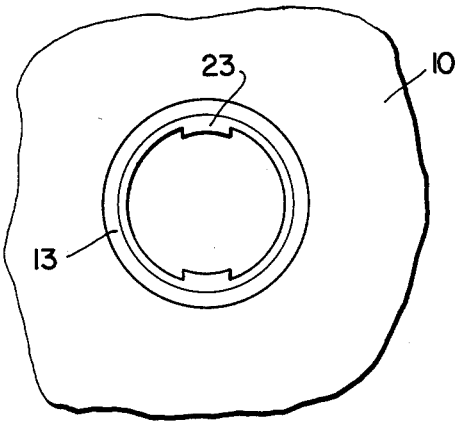
FIG. 4 is an end view of the connector provided in the inflatable air bag for receiving the hose connector.
Figure 5:
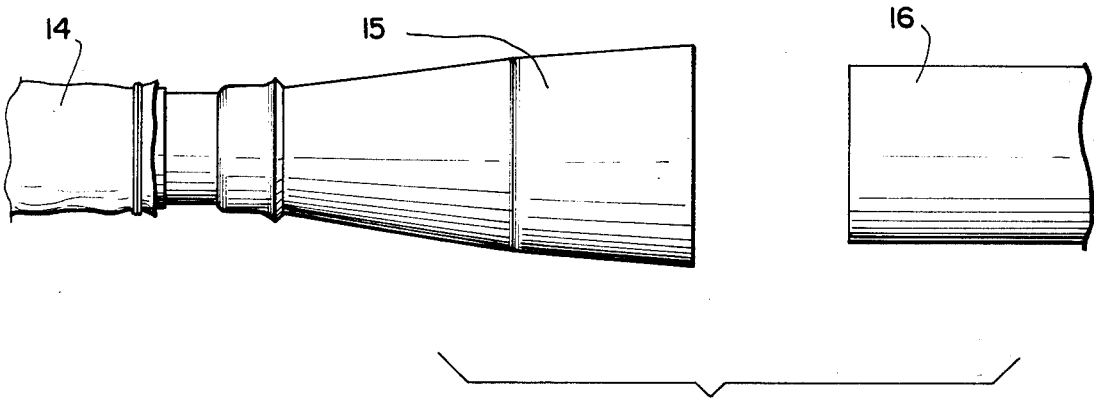
FIG. 5 is a side view showing the use of the cone shaped adapter provided at the end of the hose to facilitate connection of the hose to the exhaust system of a vehicle.

The air jack of the present invention generally includes an inflatable member, for example a balloon 10, which typically can be made of rubber or a flexible plastic. The inflatable air bag is provided with a support plate 12 which contains a plurality of projecting members attached thereto. Advantageously the support plate and spikes are made of a hard rubber or metallic material. A hose 14 is utilized to connect the exhaust system of the vehicle to the inflatable air bag, and the hose 14 has a cone-shaped adapter 15 at one end thereof to facilitate the connection of the exhaust system 16 of the automobile 17, to the inflatable air bag. A hose connector 18 is disposed at the other end of the hose 14 in order to join with the socket connector 13 provided in the inflatable air bag. A back valve 19 and an intermediate connector 20 are disposed in the hose 14 to permit ready connection and disconnection of the hose at this location. The back valve prevents the gas from escaping from the inflatable air bag when it is inflated. The hose connector 18 also includes a support 21 and an indent 22 to mate with the convex studs 23 at the entrance connector 13 of the inflatable air bag 10.

As best shown in FIG. 1, when it is desired to lift a vehicle body 17, for example in order to repair a flat tire, the user connects the two portions of hose 14 together at the back valve 19 and the intermediate connector 20. The cone-shaped end adapter 15 is then attached to the exhaust pipe of the vehicle and the other end of the hose containing hose conector 18 is attached to the entrance connector 13 provided in the inflatable air bag. The air bag is then positioned beneath the vehicle where desired, being careful that the plate 11 containing spikes 12 faces the ground.

The engine of the vehicle is then started with the exhaust gas passing through the hose 14, past the back valve 19 and valve connector 20 and into the air bag 10. As the air bag fills, the vehicle is lifted accordingly. Thus when the air bag expands to its maximum volume, the vehicle 17 can be lifted to its highest position. After the necessary repair has been made, the hose is disconnected at the connector 13 and the gas is permitted to escape from the air bag, thereby returning the vehicle to the ground.

It will be apparent to those skilled in the art that the present invention can be embodied in various forms; accordingly, this invention is to be construed and limited only by the scope of the appended claims.

What is claimed is:

1. An air jack comprising:

a hose member, containing a connecting means disposed at one end thereof, an inflatable member provided with a support plate containing a plurality of spikes attached thereto, said inflatable member being provided with a socket connector, whereby the connecting means on said hose member can be secured to the socket connector by a simple twisting action, adapter means disposed at the other end of the hose member for attaching said end of said hose member to the exhaust system of a vehicle, and back valve means disposed in said hose member for preventing a back flow of gas from said inflatable member after said gas has been introduced into said inflatable member.

2. The air jack of claim 1 wherein the inflatable member is an air bag.

3. The air jack of claim 1 wherein the adapter means has a cone-shaped configuration.

4. The air jack of claim 1, wherein the spikes are made of a hard rubber.

5. The air jack of claim 1, wherein the spikes are made of metallic material.

6. The air jack of claim 1, wherein the spikes are disposed in a uniform circular manner on the support plate.

* * * * *